US011534816B2

(12) United States Patent
Urabe

(10) Patent No.: US 11,534,816 B2
(45) Date of Patent: Dec. 27, 2022

(54) PRESS FORMING METHOD

(71) Applicant: JFE STEEL CORPORATION, Tokyo (JP)

(72) Inventor: Masaki Urabe, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 35 days.

(21) Appl. No.: 17/268,145

(22) PCT Filed: Jun. 4, 2019

(86) PCT No.: PCT/JP2019/022101
§ 371 (c)(1),
(2) Date: Feb. 12, 2021

(87) PCT Pub. No.: WO2020/039686
PCT Pub. Date: Feb. 27, 2020

(65) Prior Publication Data

US 2021/0162480 A1 Jun. 3, 2021

(30) Foreign Application Priority Data

Aug. 21, 2018 (JP) ..... JP2018-154581

(51) Int. Cl.
*B21D 22/21* (2006.01)
*B21D 22/26* (2006.01)

(52) U.S. Cl.
CPC ..... *B21D 22/26* (2013.01); *B21D 22/21* (2013.01)

(58) Field of Classification Search
CPC ..... B21D 22/02; B21D 22/06; B21D 22/20; B21D 22/21; B21D 22/22; B21D 22/24; B21D 22/26; B21D 22/30; B21D 51/88
See application file for complete search history.

(56) References Cited

U.S. PATENT DOCUMENTS 9,248,487 B2 * 2/2016 Daimaru ..... B21D 22/02
10,220,427 B2 3/2019 Yoshikawa et al.
(Continued)

FOREIGN PATENT DOCUMENTS

CN 102905809 A 1/2013
CN 105358269 A 2/2016
(Continued)

OTHER PUBLICATIONS

Sep. 20, 2021 Search Report issued in European Patent Application No. 19850876.4.
(Continued)

*Primary Examiner* — Gregory D Swiatocha
(74) *Attorney, Agent, or Firm* — Oliff PLC

(57) ABSTRACT

A method of press forming that forms a press-formed product into a target shape, the method including: forming a top portion; forming a side wall portion and a flange portion such that a side wall height of the side wall portion of the press-formed product becomes larger than a side wall height of the target shape, where the side wall height of the side wall portion is formed to be larger than the side wall height of the target shape by adding a value half or less of a radius of curvature of the ridge, in a longitudinal direction vertical cross section, of the target shape; and reforming a ridge between the side wall portion and the flange portion such that the side wall height of the side wall portion becomes the side wall height of the target shape.

3 Claims, 14 Drawing Sheets

(56) References Cited

U.S. PATENT DOCUMENTS

| | | | | |
|---|---|---|---|---|
| 10,286,436 | B2 | 5/2019 | Sumikawa et al. | |
| 10,688,551 | B2 * | 6/2020 | Aso | B21D 22/26 |
| 11,014,139 | B2 | 5/2021 | Kubo et al. | |
| 2013/0104618 | A1 | 5/2013 | Daimaru | |
| 2015/0367397 | A1 | 12/2015 | Uchiyama et al. | |
| 2016/0121384 | A1 | 5/2016 | Sumikawa et al. | |
| 2016/0263637 | A1 | 9/2016 | Yoshikawa et al. | |
| 2018/0117655 | A1 | 5/2018 | Kubo et al. | |

FOREIGN PATENT DOCUMENTS

| | | | |
|---|---|---|---|
| CN | 105792960 | A | 7/2016 |
| CN | 106660098 | A | 5/2017 |
| CN | 107969119 | A | 4/2018 |
| EP | 2578328 | A1 | 4/2013 |
| EP | 2711104 | A1 | 3/2014 |
| EP | 3015185 | A1 | 5/2016 |
| JP | 5382281 | B1 | 1/2014 |
| JP | 2015-027698 | A | 2/2015 |
| JP | 2015-131306 | A | 7/2015 |
| KR | 101388850 | B1 | 4/2014 |
| WO | 2011/148880 | A1 | 12/2011 |

OTHER PUBLICATIONS

Sep. 3, 2019 International Search Report issued in International Patent Application No. PCT/JP2019/022101.
Jan. 1, 2022 Office Action issued in Korean Patent Application No. 10-2021-7008000.
Jul. 4, 2022 Office Action issued in Chinese Patent Application No. 201980054141.2.

* cited by examiner

PRESS FORMING METHOD

FIELD

The present invention relates to a press forming method of a metal thin-sheet and especially relates to a press forming method of a press-formed product having a flange portion curved in a convex or concave manner in a height direction (vertical direction).

BACKGROUND

In press forming of a press-formed product having a top portion, a side wall portion and a flange portion, the flange portion being configured to curve at least in a convex or concave manner in a height direction, a problem arises in that springback caused by residual stress in the flange portion generated in a process of forming occurs after die release, resulting in no target flange angle being achieved. A press forming method is thus required that suppresses such springback in the press-formed product.

So far, as techniques that suppress springback in a press-formed product having a flange portion at least which is curved in a convex or concave manner in a height direction, Patent Literatures 1 and 2 disclose a method in which the flange portion is formed at different angles from that of a product shape in a plurality of forming processes to increase or decrease residual stress in a direction parallel to a bending ridge between the side wall portion and the flange portion so as to control the springback caused by the residual stress, thereby achieving shape accuracy.

CITATION LIST

Patent Literature

Patent Literature 1: Japanese Patent No. 5382281

Patent Literature 2: Japanese Patent Application Laid-open No. 2015-131306

SUMMARY

Technical Problem

In press forming of the press-formed product having the top portion, the side wall portion and the flange portion, the flange portion being configured to curve at least in a convex or concave manner in the height direction, when the flange angle is changed in the forming processes to reduce the residual stress in the flange portion, stress at a distal edge portion of the flange portion markedly changes but stress at a base portion of the flange portion hardly changes. When a trimming process is interposed between the processes for changing the flange angle in forming a press-formed product having a flange portion orthogonal to a forming direction, a cutting edge does not make contact with a workpiece orthogonal thereto in the trimming process, thereby causing a risk of occurrence of a fault such as damage of a tool of press forming. A technique is thus required that can reduce the springback by reducing the residual stress in the flange portion without change in the flange angle in a process of forming the flange portion by the multiple processes.

The invention is made in view of above problems, and aims to provide a press forming method that forms a press-formed product having a top portion, a side wall portion and a flange portion, the flange portion being configured to curve at least in a convex or concave manner in a height direction, while suppressing springback.

Solution to Problem

The inventor investigated causes of generating springback in a press-formed product 1 illustrated in FIG. 11 as an example.

The press-formed product 1 illustrated in FIG. 11 has a top portion 3, a side wall portion 5 continuing from the top portion 3, and a flange portion 7 continuing from the side wall portion 5 (FIG. 11(*a*)), and is curved in a convex manner in the height direction in the side view (FIG. 11(*b*)). The top portion 3 and the side wall portion 5 continue via a top side ridge 9 while the side wall portion 5 and the flange portion 7 continue via a flange side ridge 11. The top side ridge 9 and the flange side ridge 11 have a straight line shape along the longitudinal direction (axial direction) in the top view (FIG. 11(*c*)).

The press-formed product 1 is usually formed in a single process by performing crash forming on a blank 41 (e.g., a steel sheet) using an upper tool 51, a lower tool 53, and a pad 55. In this case, the blank 41 is sandwiched between the pad 55 and the lower tool 53 (FIG. 13(*b*)) and is curved in a convex manner in the height direction. The portion corresponding to the flange portion 7 is subjected to shrink flange deformation (FIG. 13(*c*)), and compressive stress remains in the flange portion 7 at the bottom dead center of forming (FIG. 13(*d*)).

In the press-formed product 1 after die release, the compressive stress remaining in the flange portion 7 is released and springback (elastic recovery) occurs that causes the flange portion 7 to extend in the longitudinal direction to cause the flange portion 7 to be deformed in such a way that the end portion, which is easily moved, of the flange portion 7 jumps up in the height direction, thereby reducing an angle made between the side wall portion 5 and the flange portion 7.

The inventor also investigated causes generating springback in a press-formed product 21 illustrated in FIG. 14 as an example.

The press-formed product 21 illustrated in FIG. 14 has a top portion 23, a side wall portion 25 continuing from the top portion 23, and a flange portion 27 continuing from the side wall portion 25 (FIG. 14(*a*)), and is curved in a concave manner in the height direction in the side view (FIG. 14(*b*)). The top portion 23 and the side wall portion 25 continue via a top side ridge 29 while the side wall portion 25 and the flange portion 27 continue via a flange side ridge 31. The top side ridge 29 and the flange side ridge 31 have a straight line shape along the longitudinal direction in the top view (FIG. 14(*c*)).

The press-formed product 21 is usually formed in a single process, as illustrated in FIG. 15, by performing crash forming on the blank 41 using an upper tool 61, a lower tool 63, and a pad 65. In this case, as illustrated in FIG. 16, the blank 41 is sandwiched between the pad 65 and the lower tool 63 (FIG. 16(*b*)) and is curved in a concave manner in the height direction. The portion corresponding to the flange portion 27 is subjected to stretch flange deformation (FIG. 16(*c*)), and tensile stress remains in the flange portion 27 at the bottom dead center of forming (FIG. 16(*d*)). In the press-formed product 21 after die release, the tensile stress remaining in the flange portion 27 is released, springback occurs that causes the flange portion 27 to contract in the longitudinal direction, and this springback causes the flange portion 27 to be deformed in such a way that the end portion, which is easily moved, of the flange portion 27 jumps up in the height direction, thereby reducing an angle made between the side wall portion 25 and the flange portion 27.

As described above, when the press-formed product curved in a convex or concave manner in the height direction is formed to a target shape in a single process, the springback occurs due to the stress remaining in the flange portion. It is, thus, important to reduce the stress generated in the flange portion in a process of forming, in order to suppress such spring back.

As a result of intensive studies on methods for reducing the stress generated in the flange portion, the inventor obtained knowledge that the press-formed product is to be formed by two processes and the stress generated in the flange portion is controlled by changing the side wall height of the side wall portion in a first process and a second process, thereby making it possible to suppress the springback caused by the residual stress in the flange portion. The invention is made on the basis of the knowledge. The following describes the structure.

In order to solve the problem and achieve the object, a method of press forming according to the present invention that forms a press-formed product into a target shape, the press-formed product having: a top portion; a side wall portion continuing from the top portion; and a flange portion continuing from the side wall portion via a ridge, the flange portion being configured to curve at least in a convex or concave manner in a height direction. The method includes: a first forming process that forms: the top portion having the same shape as a top portion of the target shape of the press-formed product; and the side wall portion and the flange portion such that a side wall height of the side wall portion of the press-formed product becomes larger than a side wall height of the target shape; and a second forming process that reforms the ridge between the side wall portion and the flange portion such that the side wall height of the side wall portion formed in the first forming process becomes the side wall height of the target shape, wherein the side wall height of the side wall portion formed in the first forming process is being set to be larger than the side wall height of the target shape by adding a value half or less of a radius of curvature of the ridge, in a longitudinal direction vertical cross section, of the target shape.

Advantageous Effects of Invention

The invention relates to forming of a press-formed product having a top portion, a side wall portion continuing from the top portion, and a flange portion continuing from the side wall portion via a ridge, at least the flange portion being curved in a convex or concave manner in a height direction, to a target shape, and includes a first forming process that forms the top portion having the same shape as the target shape of the press-formed product, and forms the side wall portion and the flange portion such that a side wall height is larger than the target shape, and a second forming process that reforms a ridge between the side wall portion and the flange portion such that the side wall portion formed by the first forming process has the side wall height of the target shape. The side wall height of the side wall portion formed by the first forming process is larger than the side wall height of the target shape by addition of a value half or less of a radius of curvature of the ridge in a longitudinal direction vertical cross section of the target shape. The invention, thus, can reduce stress generated in the flange portion in a process of forming to reduce springback in the press-formed product after die release.

DESCRIPTION OF EMBODIMENTS

Figure 11:
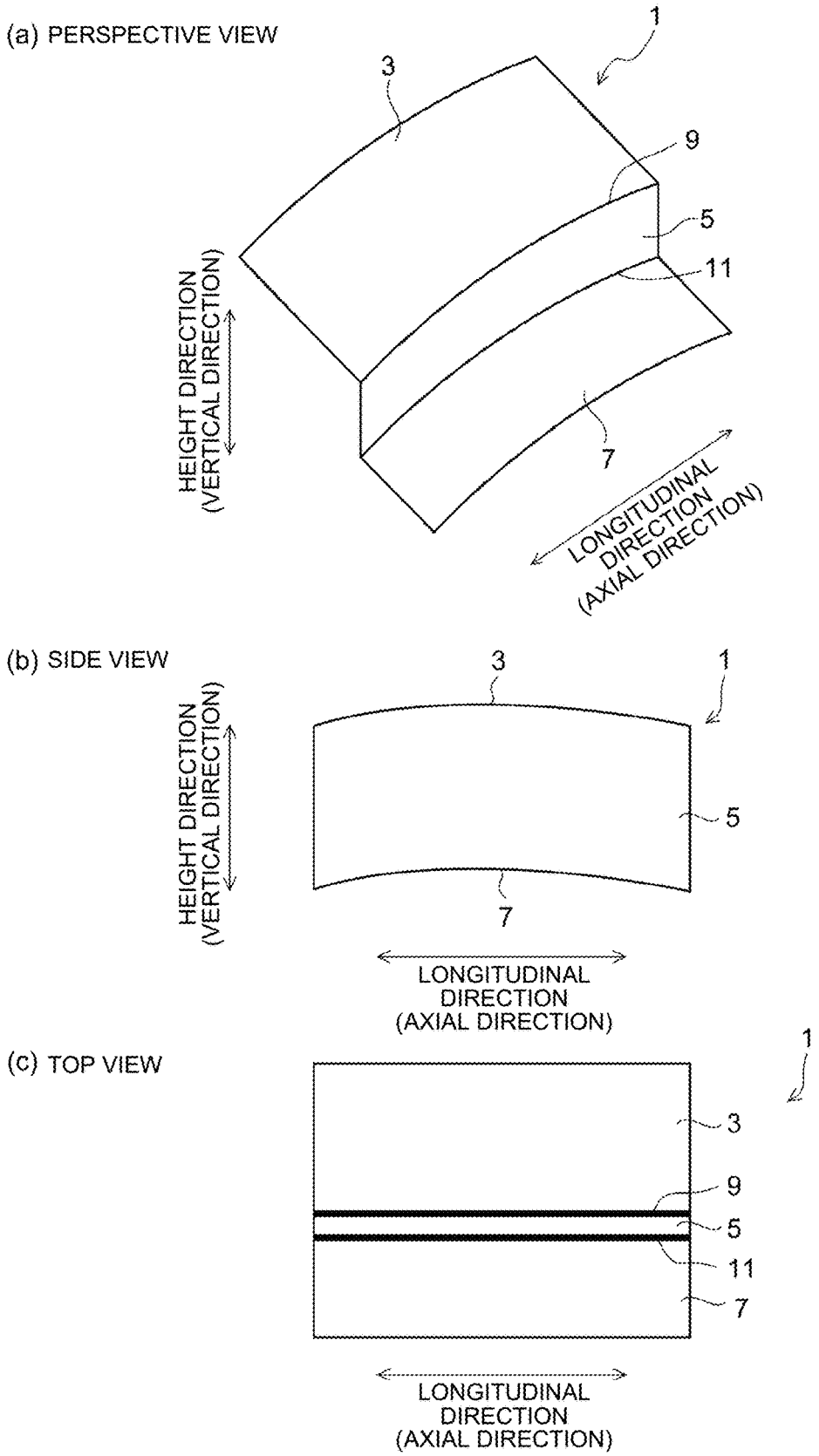
FIG. 11 is a diagram illustrating an example of the press-formed product curved in a convex manner in the height direction serving as the object in the invention ((a) is a perspective view, (b) is a side view, and (c) is a top view).
Figure 12:
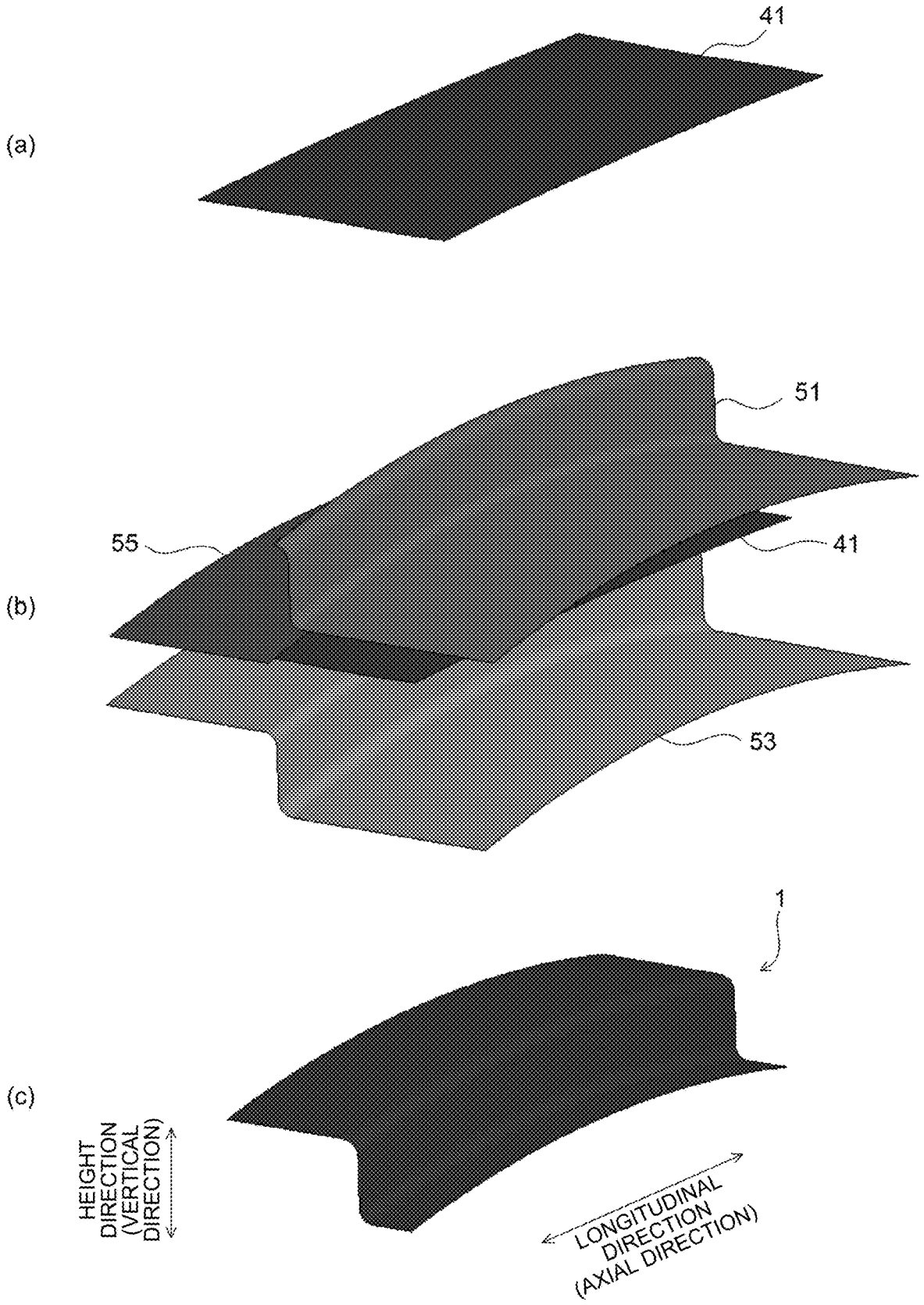
FIG. 12 is a diagram illustrating a process of forming the press-formed product curved in a convex manner in the height direction by a conventional press forming method.
Figure 13:
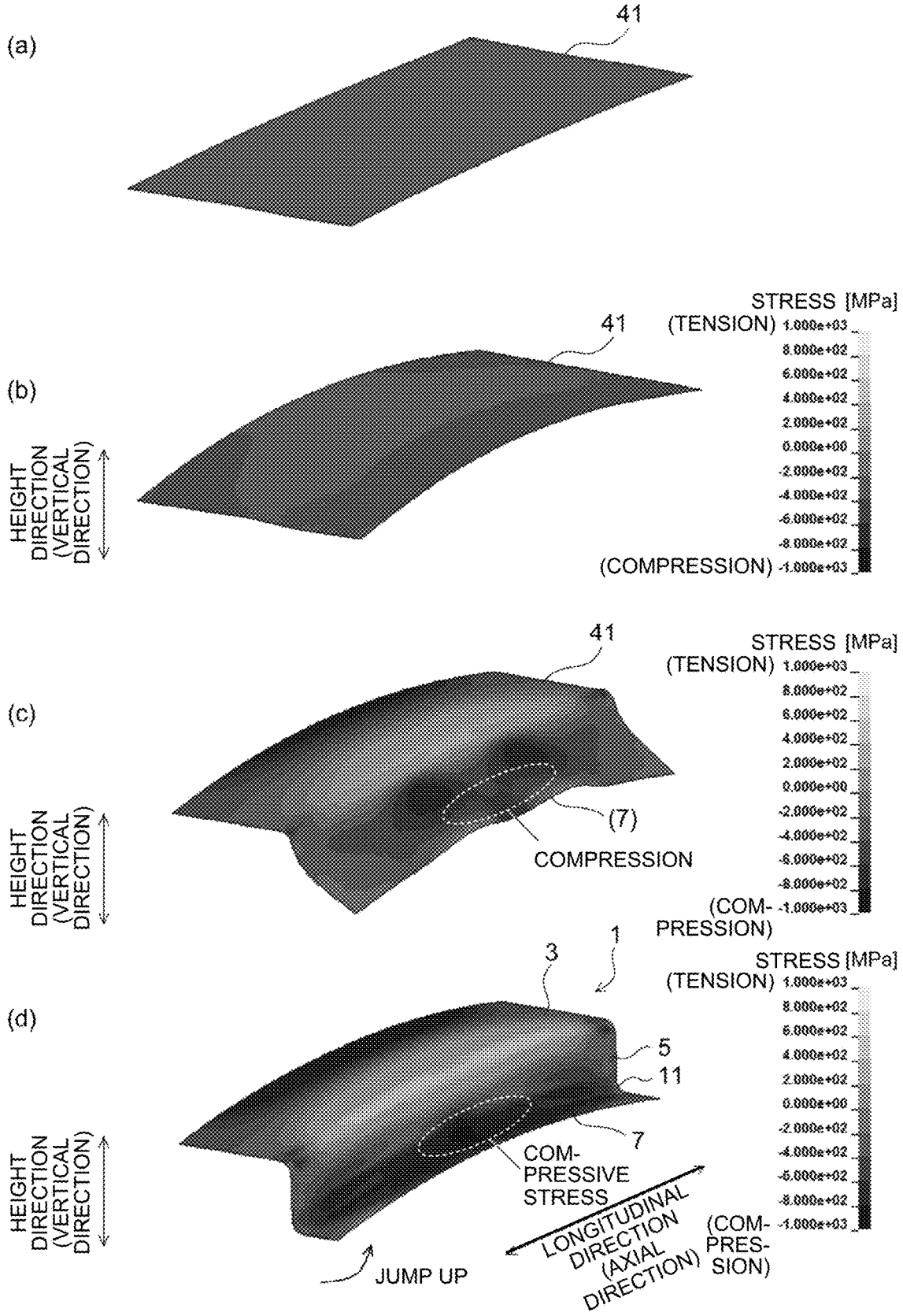
FIG. 13 is a diagram illustrating deformations of a blank and stress distributions in the process of forming the press-formed product curved in a convex manner in the height direction by the conventional press forming method.

A press forming method according to an embodiment of the invention forms the press-formed product 1 curved in a convex manner in the height direction along the longitudinal direction as exemplarily illustrated in FIG. 11 in a target shape. The press forming method includes a first forming process (FIGS. 1(*a*) and 1(*b*)) and a second forming process (FIGS. 1(*b*) and 1(*c*)). The following describes the first forming process and the second forming process.

First Forming Process

Figure 1:
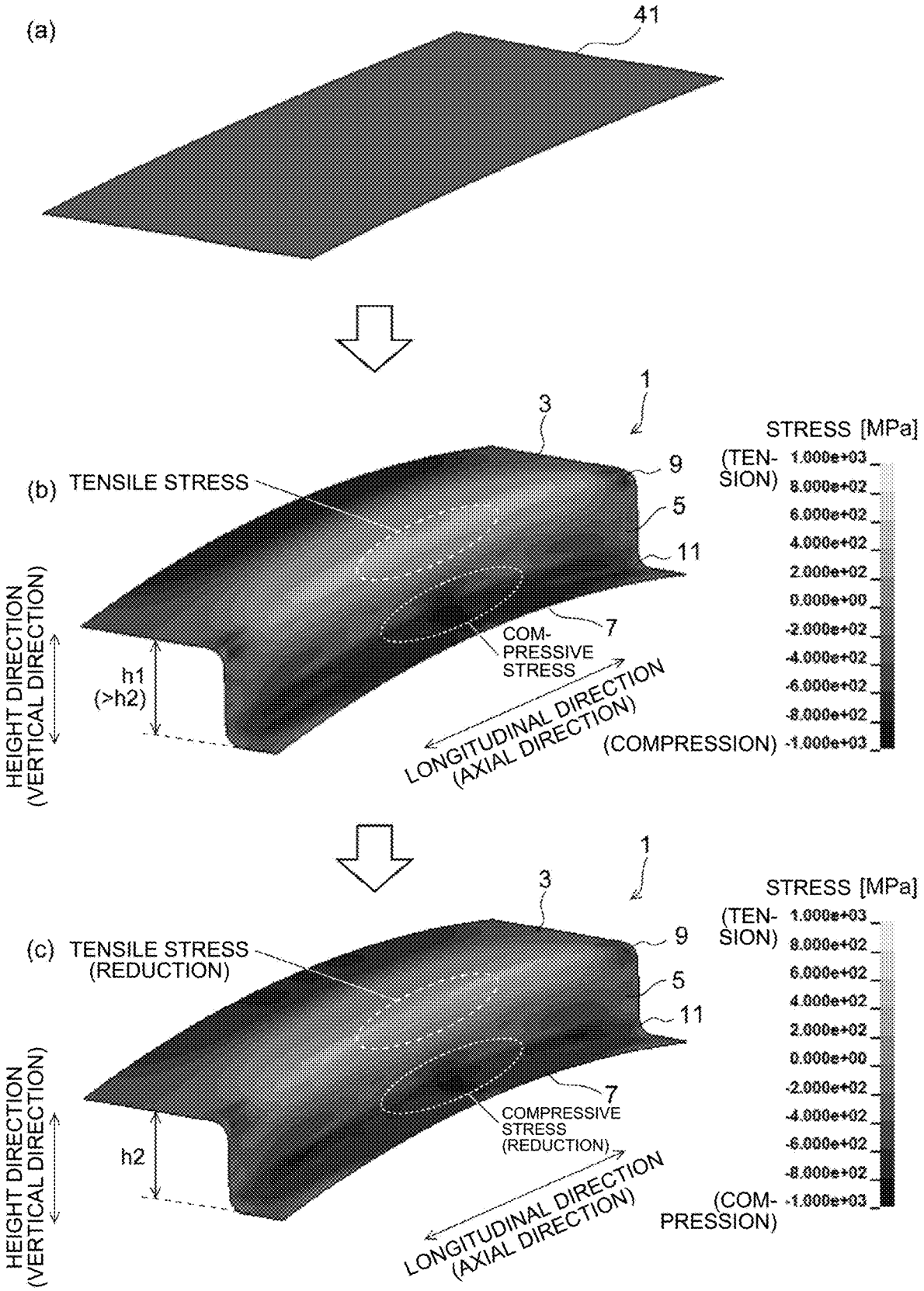
FIG. 1 is a diagram illustrating a process of forming a press-formed product curved in a convex manner in a height direction by a press forming method according to an embodiment of the invention and stress distributions in the process of forming.

As illustrated FIGS. 1(*a*) and 1(*b*), the first forming process forms the top portion 3 having the same shape as the target shape of the press-formed product 1 from the blank 41, and forms the side wall portion 5 and the flange portion 7 such that the side wall height (=h1) of the side wall portion 5 is larger than the side wall height (h2 in FIG. 1(*c*)) of the target shape (h1>h2). The side wall height h1 of the side wall portion 5 is set to be larger than the side wall height h2 of the target shape by addition of a value half or less of a radius of curvature of the flange side ridge 11 in a longitudinal direction vertical cross section of the target shape.

In the first forming process, the position of the top side ridge 9, which is the ridge between the top portion 3 and the side wall portion 5 on the blank 41, is the same as that of the target shape, and the position of the flange side ridge 11, which is the ridge between the side wall portion 5 and the flange portion 7 on the blank 41, is shifted from that of the target shape, so as to form the top portion 3 having the same shape as the target shape and form the side wall portion 5 and the flange portion 7 such that the side wall height is larger than the target shape.

In the embodiment, as illustrated in FIG. 1, the distance between the top portion 3 and the flange portion 7 in the height direction of the press-formed product 1 is the side wall height of the side wall portion 5. The side wall height of the side wall portion 5 may be a distance between the top portion 3 and the flange portion 7 in an in-plane direction on the side wall portion 5.

Second Forming Process

As illustrated in FIGS. 1(*b*) and 1(*c*), the second forming process reforms the flange side ridge 11 between the side wall portion 5 and the flange portion 7 such that the side wall portion 5 formed by the first forming process has the side wall height h2 of the target shape so as to form the press-formed product 1 having the target shape.

Figure 2:
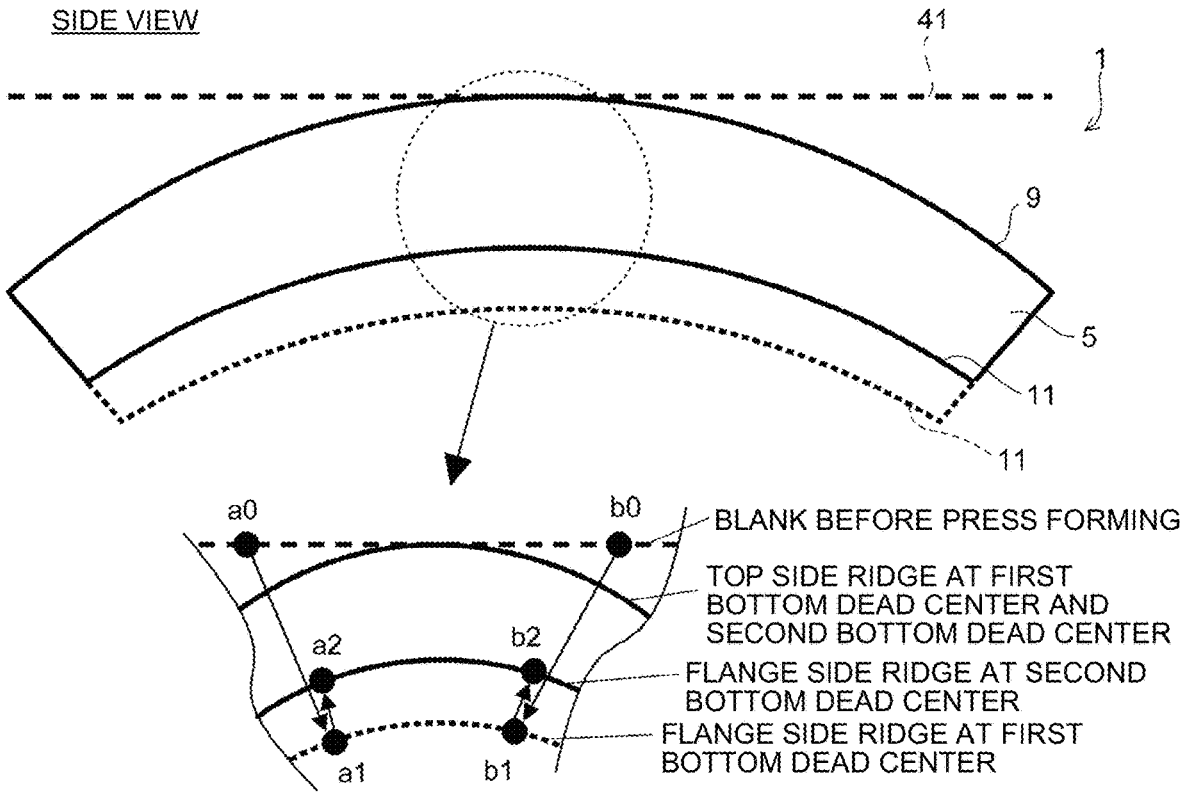
FIG. 2 is a diagram explaining a working effect of the press forming method according to the embodiment of the invention (part 1).
Figure 3:
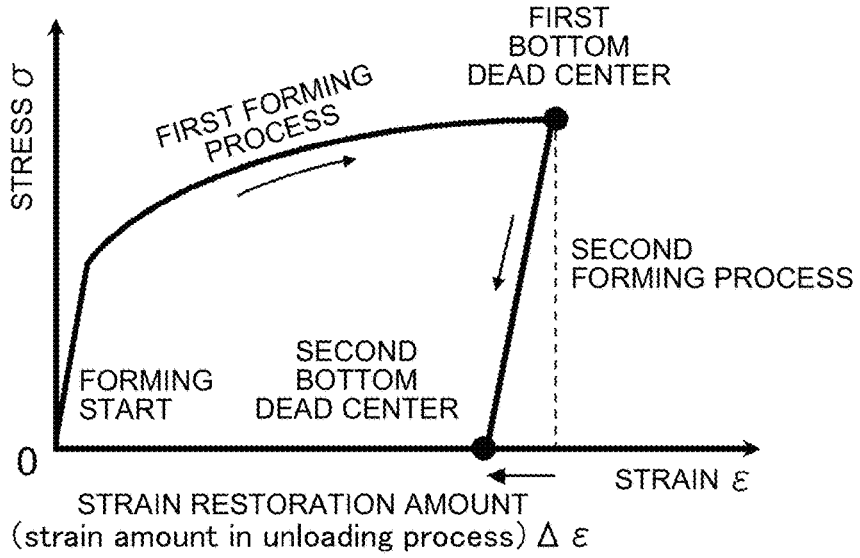
FIG. 3 is an explanatory view of a mechanism of an effect of the press forming method according to the embodiment of the invention.
Figure 4:
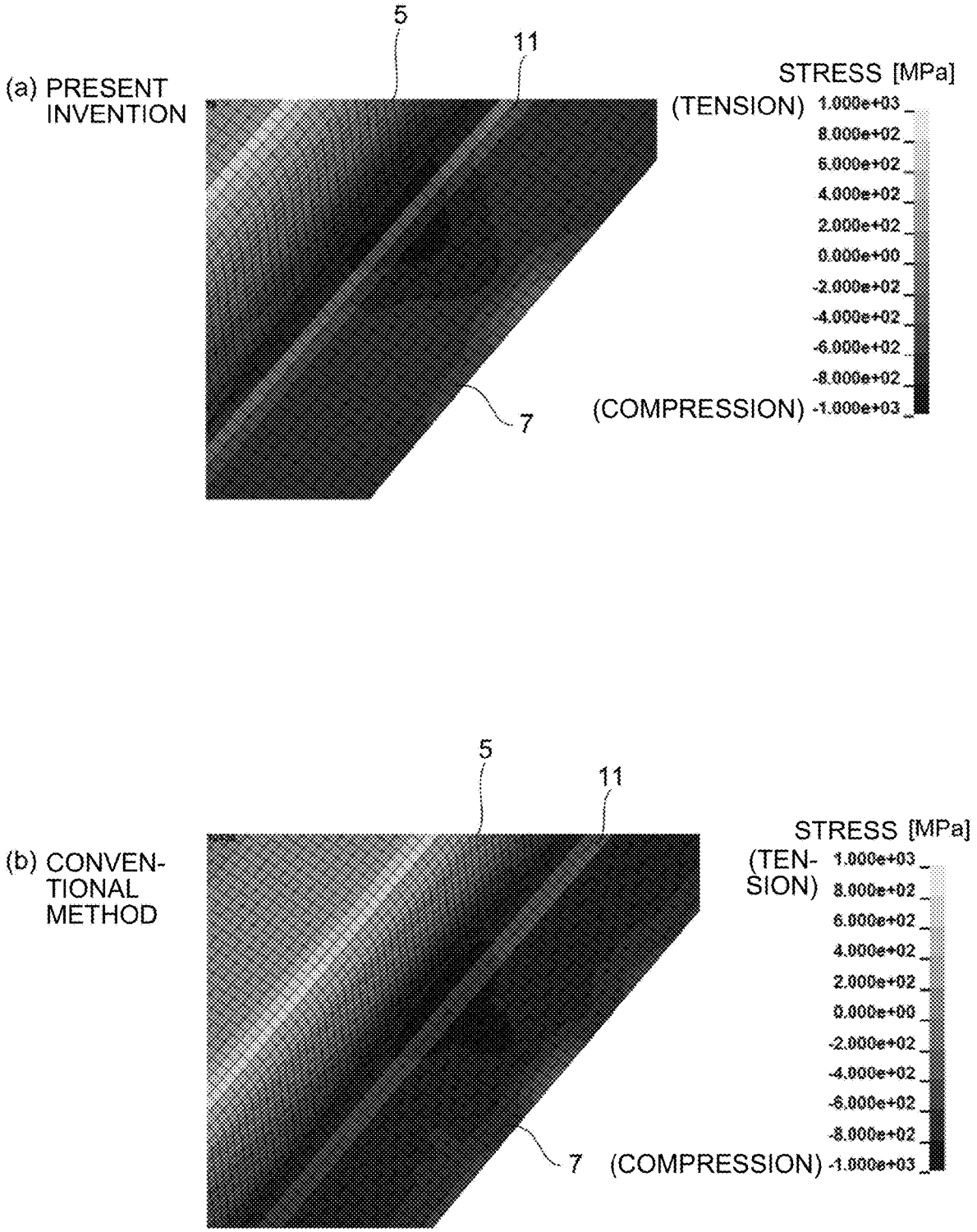
FIG. 4 is a diagram illustrating an example of the effect of the press forming method according to the embodiment of the invention (part 1).

The following describes a working effect of the press forming method according to the embodiment with reference to FIGS. 2 to 4. FIG. 2 is a diagram of the process of forming the press-formed product 1 from the blank 41 in a side view. The first bottom dead center in FIG. 2 is the bottom dead center of forming in the first forming process. The second bottom dead center in FIG. 2 is the bottom dead center of forming in the second forming process.

As described above, the first forming process forms, from the blank 41, the side wall portion 5, the flange portion 7, and the flange side ridge 11 such that the side wall height h1 of the side wall portion 5 is larger than the side wall height h2 of the target shape. The longitudinal direction length of the flange side ridge 11 formed by the first forming process is shorter than the longitudinal direction length of the portion corresponding to the flange side ridge 11 on the blank 41 before the forming process.

For example, in FIG. 2, a point a0 and a point b0 on the blank 41 before the forming process are assumed to move to a point a1 and a point b1, respectively, at the bottom dead center of forming in the first forming process, the flange length between a1 and b1 is shorter than the flange length between a0 and b0. In this way, in the first forming process, the flange portion 7 (the flange side ridge 11) is formed by being subjected to shrink flange deformation, in which the longitudinal direction length is reduced, resulting in compressive stress being generated in the flange portion 7 in the longitudinal direction.

The succeeding second forming process reforms the flange side ridge 11 such that the side wall portion 5 has the side wall height h2 of the target shape. The longitudinal direction length of the flange side ridge 11 at the bottom dead center of forming in the second forming process is longer than the longitudinal direction length at the bottom dead center of forming in the first forming process.

For example, in FIG. 2, the point a1 and the point b1 at the bottom dead center of forming (the first bottom dead center) in the first forming process are assumed to move to a point a2 and a point b2, respectively, at the bottom dead center of forming (the second bottom dead center) in the second forming process, the flange length between a2 and b2 is longer than the flange length between a1 and b1.

In the second forming process, the flange side ridge 11 is reformed such that the longitudinal direction length of the flange portion 7 is increased, resulting in tensile deformation toward outside in the longitudinal direction acting on the flange portion 7.

In this way, the flange portion 7 is formed by the first forming process in such a manner to have the longitudinal direction length shorter than that of the target shape of the press-formed product 1, and in the succeeding second forming process, the flange portion 7 is formed such that the longitudinal direction length is restored to that of the target shape of the press-formed product 1. In the first forming process, a large strain is generated in the flange portion 7, resulting in compressive stress being generated. The compressive stress is, however, significantly reduced as a result of slight restoration of the strain in the second forming process. The second forming process utilizes a characteristic that the stress is sensitively largely changed in accordance with slight restoration of the strain.

The characteristic is described with reference to FIG. 3. FIG. 3 is a stress-strain diagram in the longitudinal direction from start of forming the flange portion to the second bottom dead center. As illustrated in FIG. 3, large stress is accumulated in the flange portion at the first bottom dead center in the first forming process. The stress is, however, significantly reduced by slight restoration of the strain from the first bottom dead center to the second bottom dead center by the second forming process. In this way, the invention utilizes a characteristic that the stress is sensitively largely changed in accordance with slight restoration of the strain.

As illustrated in FIG. 4, the compressive stress in the flange portion 7 at the bottom dead center of forming in the second forming process in the invention (FIG. 4(*a*)) is further reduced than the compressive stress in the flange portion 7 generated by a conventional press forming method (FIG. 4(*b*)). As a result, this reduction makes it possible to suppress springback at die release of the press-formed product 1 after the second forming process, and to reduce a change in angle made between the side wall portion 5 and the flange portion 7.

Furthermore, the press forming method according to the embodiment can not only reduce the compressive stress in the flange portion 7 but also reduce the tensile stress in the vicinity of the top side ridge 9 between the top portion 3 and the side wall portion 5.

As illustrated in FIG. 1(*b*), tensile stress is generated in the vicinity of the top side ridge 9 at the bottom dead center of forming in the first forming process. In the second forming process, in which the flange side ridge 11 is formed such that the side wall height becomes the target shape, tensile deformation acts on the flange portion 7 while compressive deformation acts on the top side ridge 9. As a result, as illustrated in FIG. 1(*c*), the tensile stress at the bottom dead center of forming in the second forming process can be reduced in the vicinity of the top side ridge 9.

As described above, the press forming method according to the embodiment reduces the tensile stress in the top side ridge 9 in addition to the reduction of the compressive stress in the flange portion 7, thereby suppressing springback in the flange portion 7. Furthermore, the first forming process and the second forming process can perform the forming without change in the angle made between the side wall portion 5 and the flange portion 7. The flange portion 7, thus, can be formed at the target angle, e.g., horizontally (a direction orthogonal to the forming direction).

As described above, in the first forming process, the side wall height of the side wall portion 5 is set to be larger than the side wall height of the target shape by addition of a value half or less of the radius of curvature of the flange side ridge 11 in the longitudinal direction vertical cross section of the target shape. The effect of the value added to the side wall height is verified in examples described later.

Figure 14:
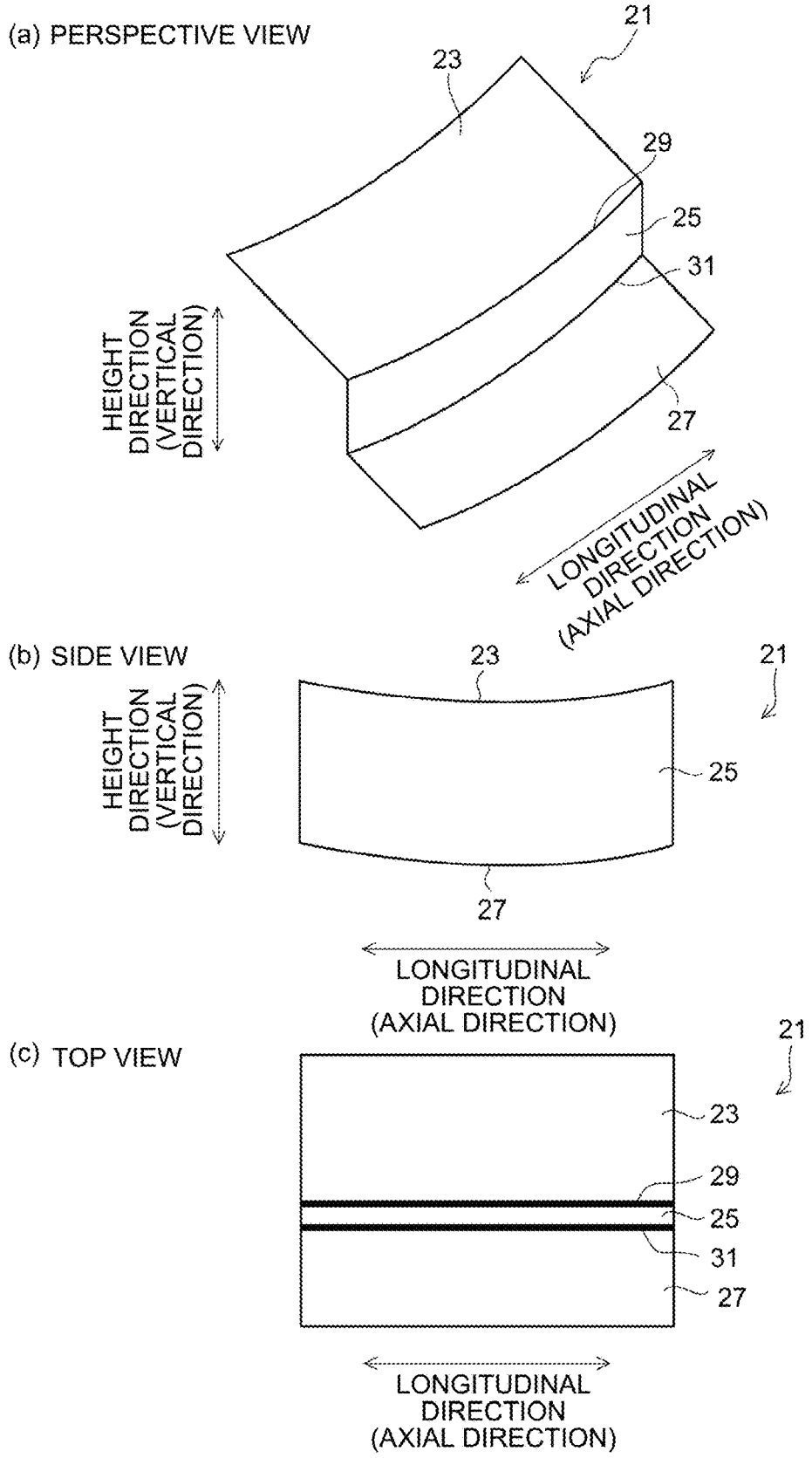
FIG. 14 is a diagram illustrating an example of the press-formed product curved in a concave manner in the height direction serving as the object in the invention ((a) is a perspective view, (b) is a side view, and (c) is a top view).
Figure 15:
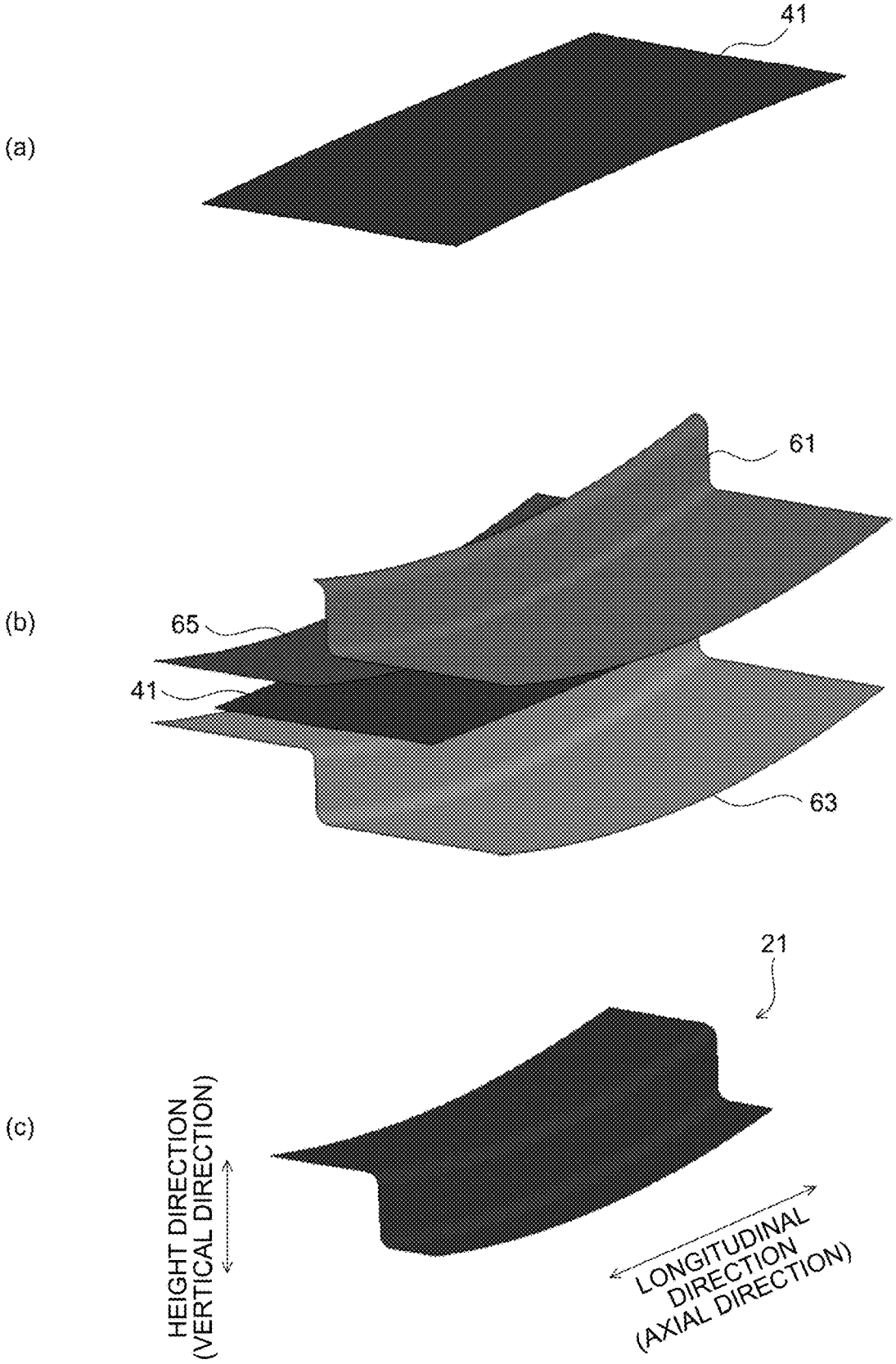
FIG. 15 is a diagram illustrating a process of forming a press-formed product curved in a concave manner in the height direction by a conventional press forming method.
Figure 16:
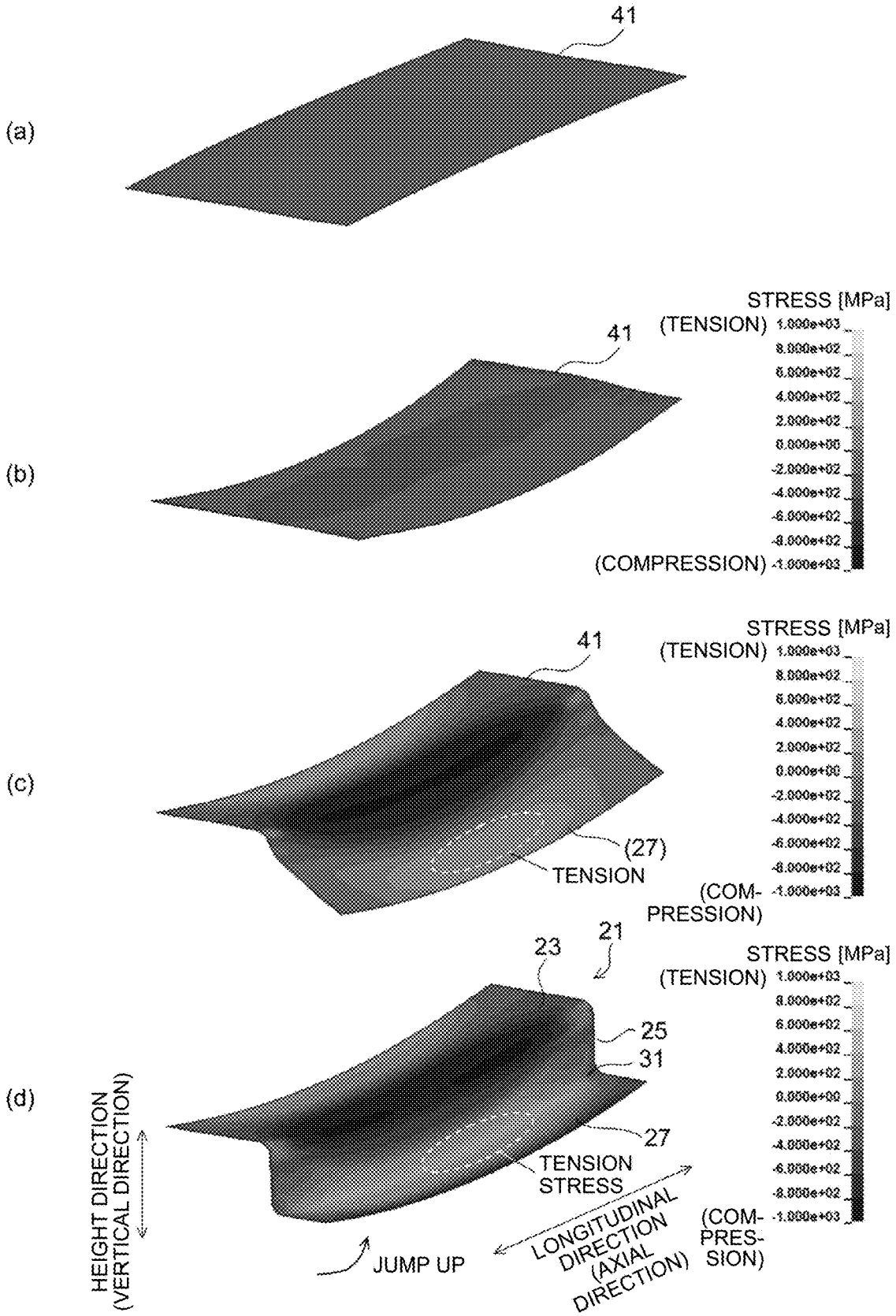
FIG. 16 is a diagram illustrating deformations of the blank and stress distributions in the process of forming the press-formed product curved in a concave manner in the height direction by the conventional press forming method.

The above describes the press-formed product 1 (refer to FIG. 11) curved in a convex manner in the height direction. The press forming method according to the invention may be applied to forming of the press-formed product 21 curved in a concave manner in the height direction as exemplarily illustrated in FIG. 14.

Figure 5:
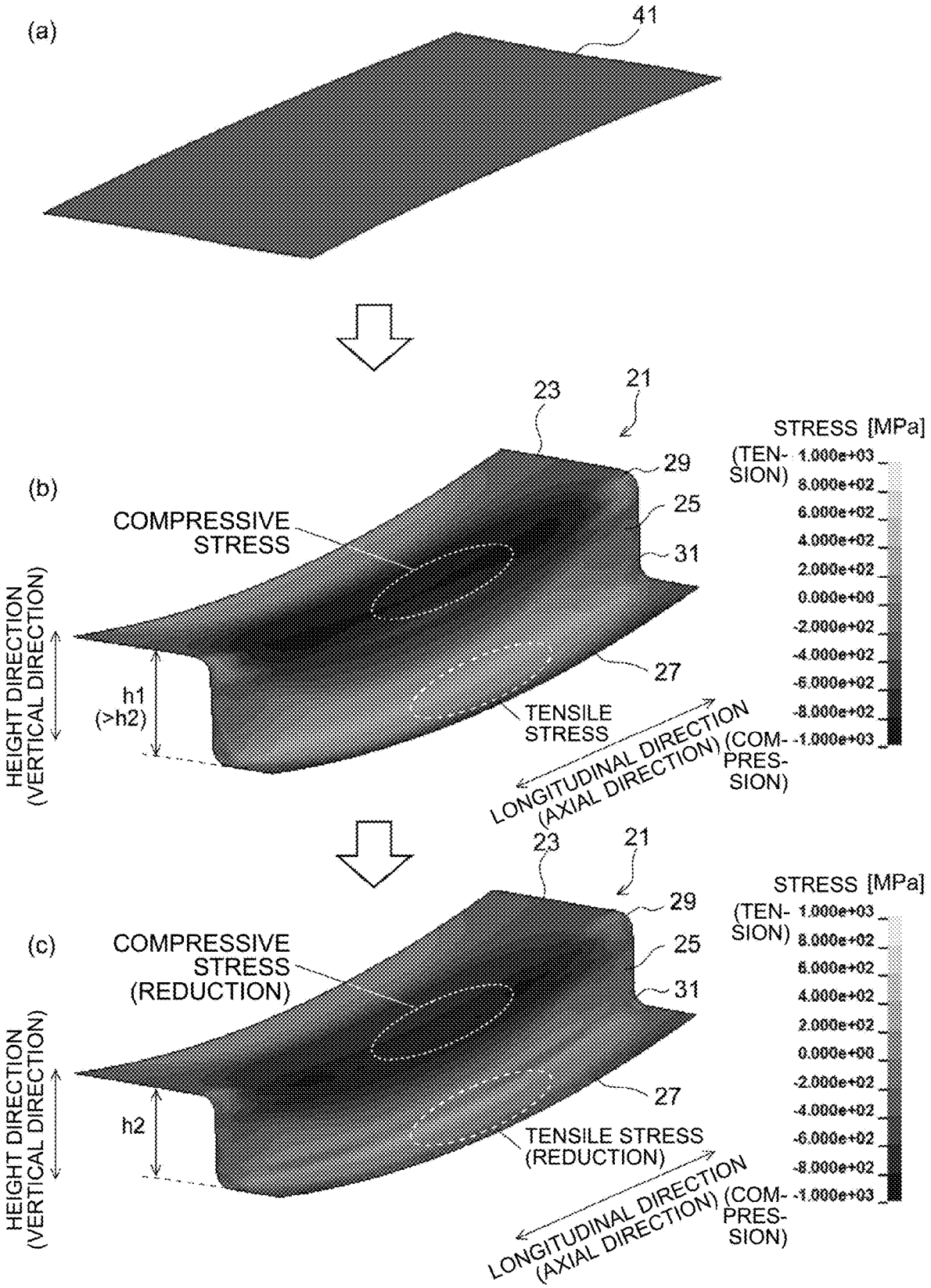
FIG. 5 is a diagram illustrating a process of forming a press-formed product curved in a concave manner in the height direction by the press forming method according to the embodiment of the invention and stress distributions in the process of forming.

When the press-formed product 21 is formed, the forming is performed by two processes as illustrated in FIG. 5, i.e., the first forming process (FIGS. 5(*a*) and 5(*b*)), and the second forming process (FIGS. 5(*b*) and 5(*c*)).

The first forming process forms the top portion 23 having the same shape as the target shape of the press-formed product 21 from the blank 41, and forms the side wall portion 25, the flange portion 27, and the flange side ridge 31 such that the side wall height hl of the side wall portion 25 is larger than the side wall height h2 of the target shape (h1>h2) (FIGS. 5(*a*) and 5(*b*)). The side wall height h1 of the side wall portion 25 is set to be larger than the side wall height h2 of the target shape by addition of a value half or less of a radius of curvature of the flange side ridge 31 in a longitudinal direction vertical cross section of the target shape.

The succeeding second forming process reforms the flange side ridge 31 between the side wall portion 25 and the flange portion 27 such that the side wall portion 25 formed in the first forming process has the side wall height h2 of the target shape so as to form the press-formed product 21 having the target shape (FIGS. 5(*b*) and 5(*c*)).

Figure 6:
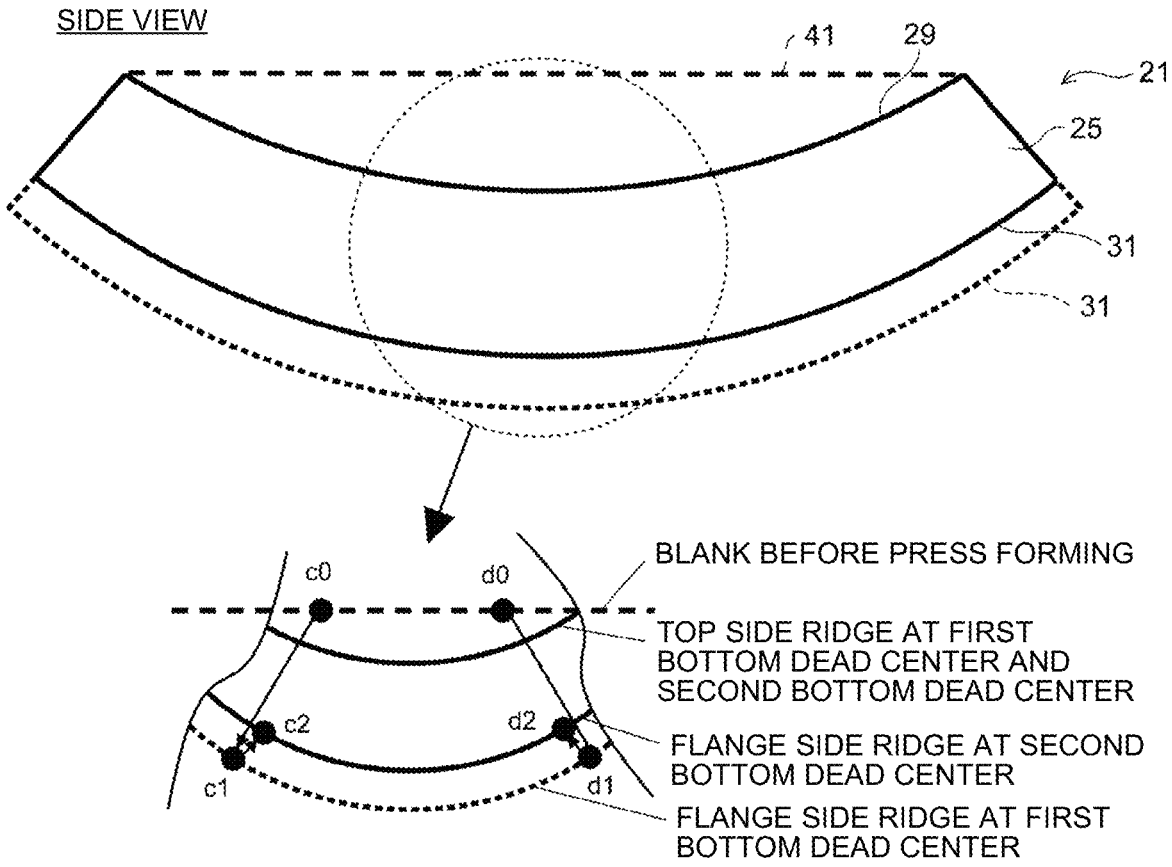
FIG. 6 is a diagram explaining the working effect of the press forming method according to the embodiment of the invention (part 2).

The working effect of the forming of the press-formed product 21 curved in a concave manner in the height direction is described with reference to FIGS. 6 and 7. FIG. 6 is a diagram of the process of forming the press-formed product 21 from the blank 41 in a side view. The first bottom dead center in FIG. 6 is the bottom dead center of forming in the first forming process. The second bottom dead center in FIG. 6 is the bottom dead center of forming in the second forming process.

As illustrated in FIG. 6, a point c0 and a point d0 on the blank 41 before the forming process are assumed to move to a point c1 and a point d1, respectively, at the bottom dead center of forming (the first bottom dead center) in the first forming process, the flange length between c1 and d1 is longer than the flange length between c0 and d0. In this way, in the first forming process, the flange portion 27 (the flange side ridge 31) is formed by being subjected to stretch flange deformation, in which the longitudinal direction length is increased, resulting in tensile stress being generated in the flange portion 27 in the longitudinal direction.

The succeeding second forming process reforms the flange side ridge 31 such that the side wall portion 25 has the side wall height h2 of the target shape. The longitudinal direction length of the flange side ridge at the bottom dead center of forming in the second forming process is shorter than the longitudinal direction length at the bottom dead center of forming in the first forming process.

For example, in FIG. 6, the point c1 and the point d1 at the bottom dead center of forming (the first bottom dead center) in the first forming process are assumed to move to a point c2 and a point d2, respectively, at the bottom dead center of forming (the second bottom dead center) in the second forming process, the flange length between c2 and d2 is shorter than the flange length between c1 and d1.

In the second forming process, the flange side ridge 31 is reformed such that the longitudinal direction length of the flange portion 27 is reduced, resulting in compressive deformation toward inside in the longitudinal direction acting on the flange portion 27.

In this way, the flange portion 27 is formed such that the longitudinal direction length is longer than that of the target shape of the press-formed product 21 in the first forming process, and in the succeeding second forming process, the flange portion 27 is formed such that the longitudinal direction length is restored to that of the target shape of the press-formed product 21. In the first forming process, a large strain is generated in the flange portion 27, resulting in tensile stress being generated. The tensile stress is, however, significantly reduced as a result of slight restoration of the strain in the second forming process. The reason is the same as that described with reference to FIG. 3.

Figure 7:
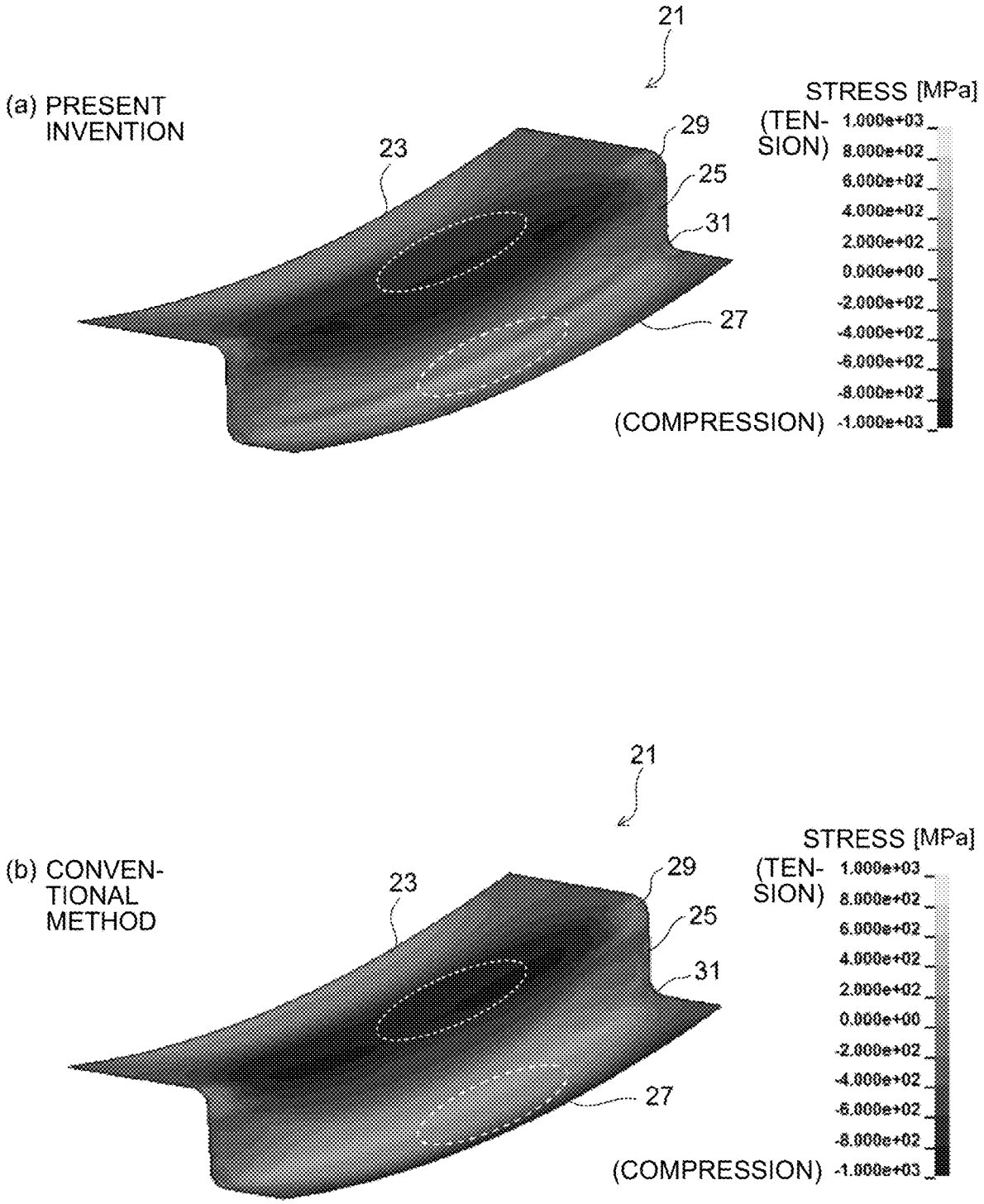
FIG. 7 is a diagram illustrating an example of the effect of the press forming method according to the embodiment of the invention (part 2).

As illustrated in FIG. 7, the tensile stress in the flange portion 27 at the bottom dead center of forming in the second forming process of the invention (FIG. 7(*a*)) is further reduced than the tensile stress in the flange portion 27 generated by the conventional press forming method (FIG. 7(*b*)). As a result, this reduction makes it possible to suppress springback at die release of the press-formed product 21 after the second forming process, and to reduce a change in angle made between the side wall portion 25 and the flange portion 27.

Furthermore, when the press-formed product 21 is formed by the press forming method according to the invention, not only the tensile stress in the flange portion 27 but also the compressive stress in the vicinity of the top side ridge 29 between the top portion 23 and the side wall portion 25 can be reduced.

As illustrated in FIG. 5(*b*), compressive stress is generated in the vicinity of the top side ridge 29 at the bottom dead center of forming in the first forming process. In the second forming process, in which the flange side ridge 31 is reformed such that the side wall height becomes the target shape, compressive deformation acts on the flange portion 27 while tensile deformation acts on the top side ridge 29. As a result, as illustrated in FIG. 5(*c*), the compressive stress at the bottom dead center of forming in the second forming process can be reduced in the vicinity of the top side ridge 29.

As described above, the press forming method according to the embodiment can reduce the compressive stress in the top side ridge 29 in addition to the reduction of the tensile stress in the flange portion 27, thereby further suppressing springback in the height direction in the flange portion 27. Furthermore, the first forming process and the second forming process can perform the forming without change in the angle made between the side wall portion 25 and the flange portion 27. The flange portion 27, thus, can be formed at the target angle, e.g., horizontally (a direction orthogonal to the forming direction).

The above describes a case where the forming object is the press-formed product in which both the top portion and the flange portion are curved in a convex or concave manner in the height direction. The invention may be applied to a press-formed product in which at least the flange portion is curved in a convex or concave manner in the height direction. The top portion may have a flat surface shape without being curved in the height direction.

For example, in a press-formed product (not illustrated) in which the top portion has a flat surface shape and the flange portion is curved in a convex manner in the height direction, the top side ridge at which the top portion and the side wall portion are connected has a straight line shape along the longitudinal direction in a side view.

When such a press-formed product is formed by the press forming method according to the invention, compressive stress is generated in the flange portion and tensile stress is generated in the vicinity of the top side ridge having a straight line shape in the first forming process in the same manner as the press-formed product 1 (refer to FIG. 1). The press forming method according to the invention can reduce the compressive stress in the flange portion and the tensile stress in the vicinity of the top side ridge having a straight line shape in the second forming process, thereby making it possible to suppress springback after die release.

In a press-formed product in which the top portion has a flat surface shape and the flange portion is curved in a concave manner, tensile stress is generated in the flange portion and compressive stress is generated in the top side ridge having a straight line shape in the first forming process in the same manner as the press-formed product 21 (refer to FIG. 5). The press forming method according to the invention can reduce the tensile stress in the flange portion and the compressive stress in the vicinity of the top side ridge having a straight line shape in the second forming process, thereby making it possible to suppress springback after die release.

The above describes the press-formed product in which the side wall portion continues from one side of the top portion. The invention may be applied to a press-formed product in which a pair of side wall portions continue from two opposing sides of the top portion, i.e., which has a hat-shaped cross section.

Examples

The verification was done for checking the working effect of the press forming method according to the invention. The following describes the verification.

Figure 8:
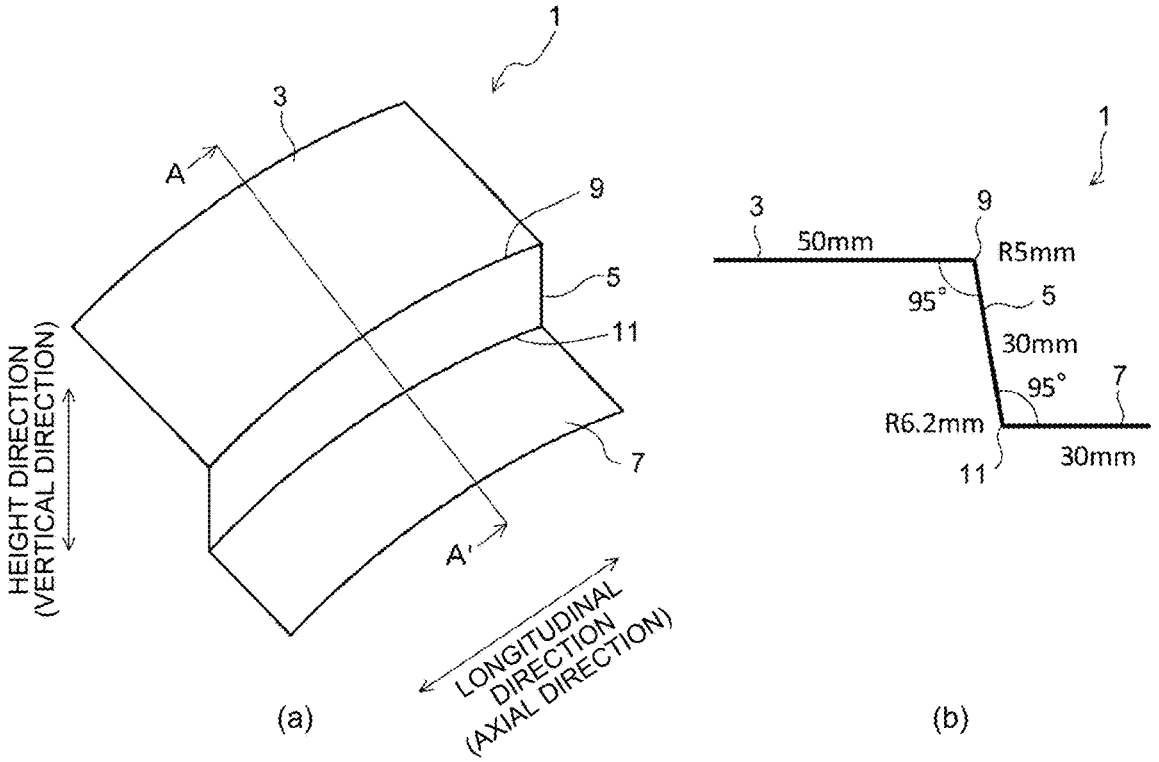
FIG. 8 is a diagram illustrating a target shape of the press-formed product curved in a convex manner in the height direction serving as a forming object in the embodiment of the invention ((a) is a perspective view and (b) is a longitudinal direction vertical cross section).

In an example, press forming analysis was performed on the press-formed product 1 illustrated in FIG. 8 serving as the forming object. Springback analysis was performed using the analysis result of the press forming analysis. On the basis of the springback analysis result, the springback in the flange portion 7 of the press-formed product 1 was evaluated.

Figure 9:
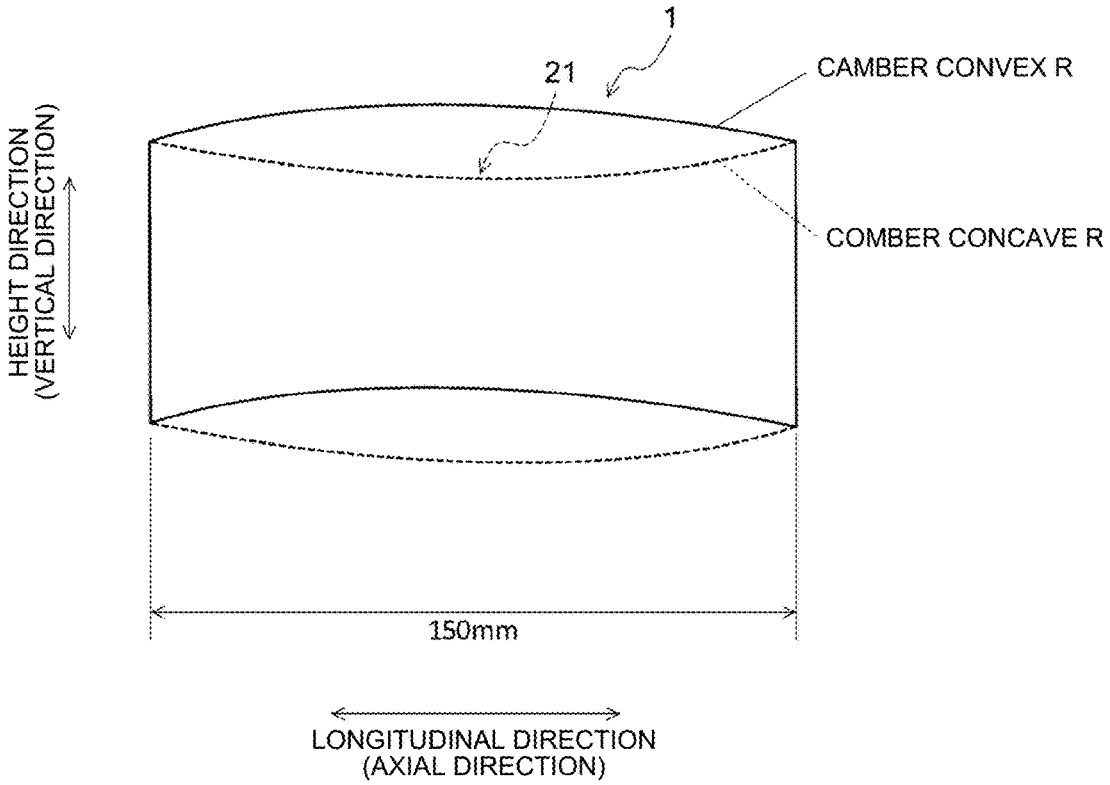
FIG. 9 is a diagram illustrating a curve in the height direction of the press-formed product serving as the forming object in the embodiment of the invention.

In the press forming analysis, a 980 MPa grade steel sheet having a thickness of 1.2 mm was used for a blank. FIGS. 8 and 9 illustrate a target shape of the press-formed product 1 serving as the forming object. The target shape of the press-formed product 1 is specified as follows. As illustrated in FIG. 9, the radius of curvature (camber convex R in FIG. 9) of the curve having a convex manner in the height direction is 1000 mm or 500 mm. As illustrated in FIG. 8(*b*), the side wall height of the side wall portion 5 is 30 mm, the angle made between the top portion 3 and the side wall portion 5 is 95°, the angle made between the side wall portion 5 and the flange portion 7 is 95°, and the top portion 3 and the flange portion 7 are in parallel (the flange portion 7 is horizontal). The radius of curvature of the top side ridge 9 in the longitudinal direction vertical cross section (A-A' arrow cross section in FIG. 8(*a*)) of the target shape is 5 mm. The radius of curvature of the flange side ridge 11 in the longitudinal direction vertical cross section (A-A' arrow cross section in FIG. 8(*a*)) of the target shape is 6.2 mm.

The press forming analysis was performed on the process of forming the press-formed product 1 by two processes, i.e., the first forming process to perform forming by changing the side wall height of the side wall portion 5 and the second forming process to perform forming such that the side wall height becomes the target shape. In the springback analysis, springback behavior obtained by the press forming analysis of the press-formed product 1 after die release at the bottom dead center of forming in the second forming process was analyzed, and an amount of change in angle between the side wall portion 5 and the flange portion 7 before die release and after the die release was obtained as a springback amount.

In the example, the press-formed product 1 formed by the press forming method according to the invention was denoted as an example. As for comparison, the press-formed product 1 formed in a single process was denoted as a conventional example, and the press-formed product 1 that was formed by two processes, i.e., the first forming process and the second forming process, and was formed by the first forming process such that the side wall height of the side wall portion 5 was out of the range of the invention was denoted as a comparative example.

Tables 1 and 2 illustrate the side wall heights h1 of the side wall portions formed by the first forming process, angles θ1, angles θ2, and angle change amounts θ1−θ2, which were obtained by the press forming analysis by changing the side wall height and the springback analysis. The angle θ1 is the angle between the side wall portion 5 and the flange portion 7 at the bottom dead center of forming. The angle θ2 is the angle between the side wall portion 5 and the flange portion 7 after die release. Table 1 illustrates the results when the radius of curvature (camber convex R) of the curve of the press-formed product 1 in the height direction was 1000 mm. Table 2 illustrates the results when the convex camber R of the press-formed product 1 was 500 mm.

TABLE 1

| | First forming process | | Second forming process | | |
|---|---|---|---|---|---|
| | Side wall height h1 (mm) | Flange angle (°) | Bottom dead center of forming θ1 (°) | After die release θ2 (°) | Angle change amount θ1 − θ2 (°) |
| Conventional Example 1 | — | | 95.0 | 91.4 | 3.6 |
| Comparative Example 1 | 30 | 0 | 95.0 | 91.2 | 3.8 |
| Comparative Example 2 | 24 | 0 | 95.0 | 91.1 | 3.9 |
| Comparative Example 3 | 26 | 0 | 95.0 | 90.4 | 4.6 |
| Comparative Example 4 | 28 | 0 | 95.0 | 89.3 | 5.7 |
| Example 1 | 31 | 0 | 95.0 | 91.9 | 3.1 |
| Example 2 | 32 | 0 | 95.0 | 92.3 | 2.7 |
| Example 3 | 33 | 0 | 95.0 | 91.7 | 3.3 |
| Comparative Example 5 | 34 | 0 | 95.0 | 89.2 | 5.8 |
| Comparative Example 6 | 36 | 0 | 95.0 | 87.2 | 7.8 |

TABLE 2

| | First forming process | | Second forming process | | |
|---|---|---|---|---|---|
| | Side wall height h1 (mm) | Flange angle (°) | Bottom dead center of forming θ1 (°) | After die release θ2 (°) | Angle change amount θ1 − θ2 (°) |
| Conventional Example 2 | — | | 95.0 | 91.1 | 3.9 |
| Comparative Example 11 | 30 | 0 | 95.0 | 91.1 | 3.9 |
| Comparative Example 12 | 24 | 0 | 95.0 | 89.0 | 6.0 |
| Comparative Example 13 | 26 | 0 | 95.0 | 89.6 | 5.4 |
| Comparative Example 14 | 28 | 0 | 95.0 | 90.6 | 4.4 |
| Example 11 | 31 | 0 | 95.0 | 91.6 | 3.4 |
| Example 12 | 32 | 0 | 95.0 | 92.0 | 3.0 |
| Example 13 | 33 | 0 | 95.0 | 91.2 | 3.8 |
| Comparative Example 15 | 34 | 0 | 95.0 | 89.7 | 5.3 |
| Comparative Example 16 | 36 | 0 | 95.0 | 88.4 | 6.6 |

In Tables 1 and 2, conventional examples 1 and 2 are examples in each of which the side wall portion 5 was formed at the side wall height h2 of the target shape in a single process by the conventional press forming analysis method.

Comparative examples 1 and 11 are examples in each of which the side wall height h1 of the side wall portion 5 formed by the first forming process was equal to the side wall height h2 of the target shape. The angle change amounts θ1−θ2 after the second forming process were about the same as those or were increased more than those of conventional results 1 and 2.

Comparative examples 2 to 4 and comparative examples 12 to 14 are examples in each of which the side wall height h1 of the side wall portion 5 formed by the first forming process was smaller than the side wall height h2 (=30 mm) of the target shape (h1<h2). The angle change amounts θ1−θ2 after the second forming process were larger than that of conventional example 1 or 2. The results show that springback was increased.

Examples 1 to 3 and examples 11 to 13 are examples in each of which the side wall height h1 of the side wall portion 5 formed by the first forming process was set to be larger than the side wall height h2 (=30 mm) of the target shape by addition of a value half or less of the radius of curvature (=6.2 mm) of the flange side ridge 11 in the longitudinal direction vertical cross section of the target shape. The angle change amounts θ1−θ2 after the second forming process were smaller than those of conventional examples. The results show that springback was suppressed.

Comparative examples 5 and 6 and comparative examples 15 and 16 are examples in each of which the side wall height h1 of the side wall portion 5 formed by the first forming process was set to be larger than the side wall height h2 of the target shape by addition of a value exceeding half of the radius of curvature of the flange side ridge 11 in the longitudinal direction vertical cross section of the target shape. The angle change amounts θ1−θ2 after the second forming process were larger than that of conventional example 1 or 2. The results show springback was increased.

The results described above indicated that a change in angle between the side wall portion 5 and the flange portion 7 caused by springback was able to be reduced by forming the press-formed product 1 curved in a convex manner in the height direction by two processes, i.e., the first forming process and the second forming process with a condition that the side wall height h1 of the side wall portion 5 is set to be larger than the side wall height h2 of the target shape in the first forming process by addition of a value half or less of the radius of curvature of the flange side ridge 11 in the longitudinal direction vertical cross section of the target shape.

Another example was also examined where a press-formed product curved in a concave manner in the height direction was formed by the press forming method according to the invention.

Figure 10:
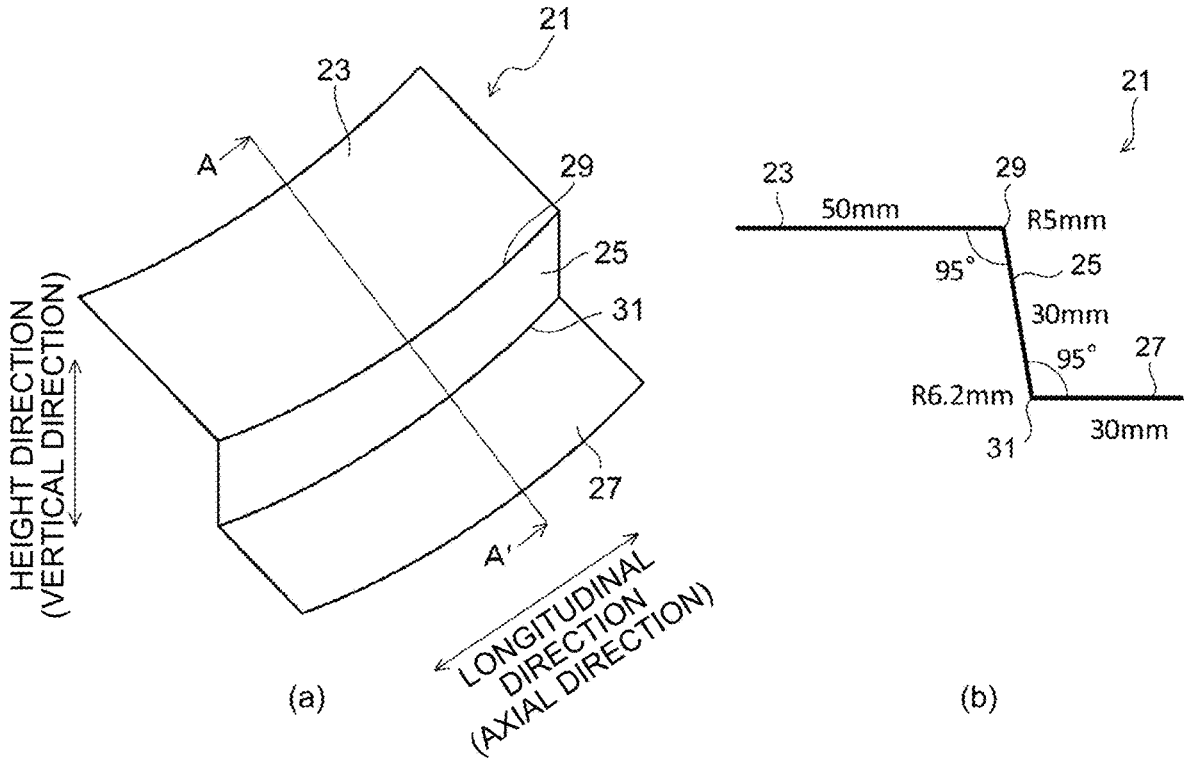
FIG. 10 is a diagram illustrating a target shape of the press-formed product curved in a concave manner in the height direction serving as a forming object in the embodiment of the invention ((a) is a perspective view and (b) is a longitudinal direction vertical cross section).

In the same manner as the press-formed product 1 curved in a convex manner described above, the press forming analysis was performed on the press-formed product 21 illustrated in FIG. 10 as an analysis object, and the springback analysis was performed using the press forming analysis result. On the basis of the springback analysis result, the springback in the flange portion 27 of the press-formed product 21 was evaluated.

In the press forming analysis, a 980 MPa grade steel sheet having a thickness of 1.2 mm was used for a blank. FIGS. 9 and 10 illustrate a target shape of the press-formed product 21 serving as the forming object. The target shape of the press-formed product 21 is specified as follows. As illustrated in FIG. 9, the radius of curvature (camber concave R in FIG. 9) of the curve having a concave manner in the height direction is 1000 mm or 500 mm. As illustrated in FIG. 10(*b*), the side wall height of the side wall portion 25 is 30 mm, the angle made between the top portion 23 and the side wall portion 25 is 95°, the angle made between the side wall portion 25 and the flange portion 27 is 95°, and the top portion 23 and the flange portion 27 are in parallel (the flange portion 27 is horizontal). The radius of curvature of the top side ridge 29 in the longitudinal direction vertical cross section (A-A' arrow cross section in FIG. 10(*a*)) of the target shape is 5 mm. The radius of curvature of the flange side ridge 31 in the longitudinal direction vertical cross section (A-A' arrow cross section in FIG. 10(*a*)) of the target shape is 6.2 mm.

The press forming analysis was performed on the process of forming the press-formed product 21 by two processes, i.e., the first forming process to perform forming by changing the side wall height h1 of the side wall portion 25 and the second forming process to reform the flange side ridge 31 in such a manner to have the side wall height h2 of the target shape. In the springback analysis, springback behavior of the press-formed product 21 after die release was analyzed, and an amount of change in angle between the side wall portion 25 and the flange portion 27 before die release and after die release was obtained as the springback amount.

The press-formed product 21 curved in a concave manner formed by the press forming method according to the invention was denoted as the example. As for comparison, the press-formed product 21 formed in a single process was denoted as the conventional example, and the press-formed product 21 that was formed by two processes, i.e., the first forming process and the second forming process, and was formed by the first forming process such that the side wall height h1 of the side wall portion 25 was out of the range of the invention was denoted as the comparative example.

Tables 3 and 4 illustrate the side wall heights h1 of the side wall portions 25 formed by the first forming process, angles θ1, angles θ2, and angle change amounts θ1−θ2, which were obtained by the press forming analysis by changing the side wall height and the springback analysis. The angle θ1 is the angle between the side wall portion 25 and the flange portion 27 at the bottom dead center of forming. The angle θ2 is the angle between the side wall portion 25 and the flange portion 27 after die release. Table 3 illustrates the results when the radius of curvature (camber concave R) of the curve of the press-formed product 21 in the height direction was 1000 mm. Table 4 illustrates the results when the camber concave R of the press-formed product 21 was 500 mm.

TABLE 3

| | First forming process | | Second forming process | | |
|---|---|---|---|---|---|
| | Side wall height h1 (mm) | Flange angle (°) | Bottom dead center of forming θ1 (°) | After die release θ2 (°) | Angle change amount θ1 − θ2 (°) |
| Conventional Example 3 | — | | 95.0 | 91.7 | 3.3 |
| Comparative Example 21 | 30 | 0 | 95.0 | 91.7 | 3.3 |
| Comparative Example 22 | 24 | 0 | 95.0 | 91.2 | 3.8 |
| Comparative Example 23 | 26 | 0 | 95.0 | 90.8 | 4.2 |
| Comparative Example 24 | 28 | 0 | 95.0 | 88.9 | 6.1 |
| Example 21 | 31 | 0 | 95.0 | 93.2 | 1.8 |
| Example 22 | 32 | 0 | 95.0 | 94.0 | 1.0 |
| Example 23 | 33 | 0 | 95.0 | 93.0 | 2.0 |
| Comparative Example 25 | 34 | 0 | 95.0 | 90.9 | 4.1 |
| Comparative Example 26 | 36 | 0 | 95.0 | 87.8 | 7.2 |

TABLE 4

| | First forming process | | Second forming process | | |
|---|---|---|---|---|---|
| | Side wall height h1 (mm) | Flange angle (°) | Bottom dead center of forming θ1 (°) | After die release θ2 (°) | Angle change amount θ1 − θ2 (°) |
| Conventional Example 4 | — | | 95.0 | 92.2 | 2.8 |
| Comparative Example 31 | 30 | 0 | 95.0 | 91.8 | 3.2 |
| Comparative Example 32 | 24 | 0 | 95.0 | 91.5 | 3.5 |
| Comparative Example 33 | 26 | 0 | 95.0 | 91.3 | 3.7 |
| Comparative Example 34 | 28 | 0 | 95.0 | 90.1 | 4.9 |
| Example 31 | 31 | 0 | 95.0 | 92.5 | 2.5 |
| Example 32 | 32 | 0 | 95.0 | 94.7 | 0.3 |
| Example 33 | 33 | 0 | 95.0 | 93.4 | 1.6 |
| Comparative Example 35 | 34 | 0 | 95.0 | 92.0 | 3.0 |
| Comparative Example 36 | 36 | 0 | 95.0 | 87.8 | 7.2 |

In Tables 3 and 4, conventional examples 3 and 4 are examples in each of which the side wall height h2 of the target shape was formed in a single process by the conventional press forming analysis method.

Comparative examples 21 and 31 are examples in each of which the side wall height h1 of the side wall portion 25 formed by the first forming process was equal to the side wall height h2 of the target shape. The angle change amounts θ1−θ2 after the second forming process were about the same as those or were increased more than those of conventional results 3 and 4.

Comparative examples 22 to 24 and comparative examples 32 to 34 are examples in each of which the side wall height h1 of the side wall portion 25 formed by the first forming process was smaller than the side wall height h2 (=30 mm) of the target shape (h1<h2). The angle change amounts θ1−θ2 after the second forming process were larger than that of conventional example 3 or 4. The results show that springback was increased.

Examples 21 to 23 and examples 31 to 33 are examples in each of which the side wall height h1 of the side wall portion 25 formed by the first forming process was set to be larger than the side wall height h2 (=30 mm) of the target shape by addition of a value half or less of the radius of curvature (=6.2 mm) of the flange side ridge 31 in the longitudinal direction vertical cross section of the target shape. The angle change amounts θ1−θ2 after the second forming process were smaller than that of conventional example 3 or 4. The results show that springback was suppressed.

Comparative examples 25 and 26 and comparative examples 35 and 36 are examples in each of which the side wall height h1 of the side wall portion 25 formed by the first forming process was set to be larger than the side wall height h2 of the target shape by addition of a value exceeding half of the radius of curvature of the flange side ridge 31 in the longitudinal direction vertical cross section of the target shape. The angle change amounts θ1−θ2 after the second forming process were larger than that of conventional example 3 or 4. The results show that springback was increased.

The results described above indicated that a change in angle between the side wall portion 25 and the flange portion 27 caused by springback after die release was able to be reduced by forming the press-formed product 21 curved in a concave manner in the height direction by two processes, i.e., the first forming process and the second forming process with a condition that the side wall height h1 of the side wall portion 25 is set to be larger than the side wall height h2 of the target shape in the first forming process by addition of a value half or less of the radius of curvature of the flange side ridge 31 in the longitudinal direction vertical cross section of the target shape.

INDUSTRIAL APPLICABILITY

The present invention can provide a press forming method that forms a press-formed product having a top portion, a side wall portion and a flange portion, the flange portion being configured to curve at least in a convex or concave manner in a height direction, while suppressing springback.

REFERENCE SIGNS LIST

1 press-formed product (curved in a convex manner)
3 top portion
5 side wall portion
7 flange portion
9 top side ridge
11 flange side ridge
21 press-formed product (curved in a concave manner)
23 top portion
25 side wall portion
27 flange portion
29 top side ridge
31 flange side ridge
41 blank
51 upper tool
53 lower tool
55 pad
61 upper tool
63 lower tool
65 pad
h1 side wall height (bottom dead center in a first forming process)
h2 side wall height (target shape)

The invention claimed is:

1. A method of press forming a blank into a press-formed product having a desired target shape, while suppressing springback, the press-formed product having a top portion, a side wall portion continuing from the top portion, and a flange portion continuing from the side wall portion via a ridge, the flange portion being configured to curve at least in a convex or concave manner in a height direction, the method comprising:

a first forming process of forming from the blank the top portion having the same shape as a top portion of the desired target shape, and forming from the blank the side wall portion and the flange portion by shifting a position of the ridge compared to that of the desired target shape such that a side wall height of the side wall portion becomes larger than the side wall height of the desired target shape, where the side wall height of the side wall portion is formed to be larger than the side wall height of the desired target shape by adding a value half or less of a radius of curvature of the ridge, in a longitudinal direction vertical cross section, of the desired target shape; and a second forming process of reforming the ridge between the side wall portion and the flange portion such that the side wall height of the side wall portion in the press-formed product corresponds to the side wall height of the desired target shape, wherein the flange portion is formed by the first forming process so as to have the longitudinal direction length shorter or longer than that of the desired target shape, and in the second forming process, the flange portion is formed such that the longitudinal direction length is restored to that of the desired target shape.

2. The method of press forming a blank into a press-formed product according to claim 1, wherein the ridge is a flange side ridge, and the side wall portion continues from the top portion via a top side ridge.

3. The method of press forming a blank into a press-formed product according to claim 2, wherein the flange side ridge and the top side ridge are parallel.

* * * * *